US005739815A

United States Patent [19]

Mizutani

[11] Patent Number: 5,739,815

[45] Date of Patent: Apr. 14, 1998

[54] METHOD AND APPARATUS FOR DISPLAYING IMAGE

[75] Inventor: Akihiro Mizutani, Kawasaki, Japan

[73] Assignee: Fujitsu Limited, Kawasaki, Japan

[21] Appl. No.: 680,973

[22] Filed: Jul. 16, 1996

Related U.S. Application Data

[63] Continuation of Ser. No. 370,455, Jan. 9, 1995, abandoned, which is a continuation of Ser. No. 115,823, Sep. 3, 1993, abandoned.

[30] Foreign Application Priority Data

Mar. 15, 1993 [JP] Japan ..... 5-053493

[51] Int. Cl.[6] ..... G09G 5/06

[52] U.S. Cl. ..... 345/199; 345/150; 345/118

[58] Field of Search ..... 345/118, 119, 345/115, 121, 150, 153, 155, 199; 395/340, 343

[56] References Cited

U.S. PATENT DOCUMENTS

| | | | |
|---|---|---|---|
| 4,533,910 | 8/1985 | Sukonick et al. | 345/118 |
| 4,710,806 | 12/1987 | Iwai et al. | 345/199 |
| 4,769,762 | 9/1988 | Tsujido | 345/119 |
| 4,860,218 | 8/1989 | Sleator | 345/119 |
| 5,091,717 | 2/1992 | Carrie et al. | 345/199 |
| 5,570,115 | 10/1996 | Kawai et al. | 345/199 |

*Primary Examiner*—Xiao Wu

*Attorney, Agent, or Firm*—Staas & Halsey

[57] ABSTRACT

An image display system comprises an area setting section, an area detecting section, an interrupt generating section, and a palette writing section. In order to divide a display screen into a plurality of small screen areas, the area setting section sets the head position of each of the areas. When the area detecting section detects the head position of a small screen area, the interrupt generating section generates an interrupt. In response to the interrupt, the palette writing section writes display color information for the small screen area into a palette. This system permits each of the small screen areas to be associated with a substantially different palette.

18 Claims, 11 Drawing Sheets

FIG. 8

| AREA HEAD POSITION REGISTER | HORIZONTAL SCAN LINE NUMBER |
|---|---|
| REGISTER 5-1 | H1 |
| REGISTER 5-2 | H2 |
| . . . | . . . |
| REGISTER 5-(n-1) | Hn-1 |
| REGISTER 5-n | Hn |

FIG. 9

| INTERRUPT | PALETTE SETTING DATA |
|---|---|
| I1 | P1 |
| I2 | P2 |
| . . . | . . . |
| In-1 | Pn |
| In | P1 |

METHOD AND APPARATUS FOR DISPLAYING IMAGE

This application is a continuation of application Ser. No. 08/370,455, filed Jan. 9, 1995, now abandoned, which is a continuation of application Ser. No. 08/115,823 filed Sep. 3, 1993, now abandoned.

BACKGROUND OF THE INVENTION

1. Field of the Invention

The present invention relates to an image displaying technique, and more particularly to an image displaying method and apparatus for displaying multicolor images on a display screen.

2. Description of the Related Art

In conventional image display systems for displaying image data digitally, such as displays in computer systems, the capacity of a RAM (random access memory) which can be utilized for image display is usually limited. There is a color representation technique that uses a palette, i.e., a lookup table in order to display many colors on the screen of a display, such as a cathode ray tube (CRT), using such a RAM having a limited capacity.

For example, in order to represent more than 16 colors on a system which is permitted to display only 16 colors, a palette can be used to display arbitrary 16 colors selected out of a range of 4,096 colors. In this case, a palette of color image data consisting of R (red), G (green), and B (blue) color information for display of 4,096 colors is prepared, and 16 desired colors are selected from the palette to display a color image.

Likewise, in order for a system adapted to the display of only 256 colors to select 256 desired display colors from 16,000 colors, it is necessary to prepare a palette of 16,000 colors. Colors are specified to the palette, so that 256 desired colors are displayed.

Thus, in a system using a palette to display only 16 or 256 colors which are a portion of representable colors, the number of colors which can be displayed simultaneously on the same screen is limited to 16 or 256 because palette-based color selection covers the entire screen.

In order to meet this problem, a technique has been used recently in which an application program is permitted to divide the display screen into a plurality of small screen areas (i.e., sub-screen areas) and specify colors to a palette for each of the small screen areas, thereby varying the contents of 16 or 256 displayable colors among the screen areas. This increases the number of colors which can be displayed simultaneously on the entire screen to over 16 or 256 colors, permitting a wide variety of color representation.

In this case, the application program is required to perform polling for dividing the display screen into a plurality of small areas. That is, in order to determine each of the small screen areas, it is necessary to count horizontal sync signals used for image display and examine whether or not the count has reached the boundary of each small screen area. With such a system, the main program may have to be suspended so as to perform the polling, reducing the efficiency of the application program itself.

SUMMARY OF THE INVENTION

It is therefore an object of the present invention to provide an image display method and apparatus which, without the need for an application program to perform polling, permits display colors on each of a plurality of small screen areas to be set by individually using a palette and more colors than are simultaneously representable by the use of a single palette to be displayed on the entire screen.

The image display system of the present invention is directed to an image display device which uses display color information in a palette for color representation on a screen and is provided with an area setting section, an area detecting section, an interrupt generating section, and a palette writing section.

The area setting section sets the head position of each of small screen areas into which a screen is divided.

The area detecting section detects the head position of each area set by the area setting section. The interrupt generating section generates an interrupt each time the area detecting section detects the head position of a small screen area.

The palette writing section is responsive to the occurrence of an interrupt in the interrupt generating section to write (update) display color information for the corresponding small screen area into the palette.

That is, with this system, the area setting section first sets the head position of each of small screen areas into which one screen is divided. Subsequently the head position of each of the small screen areas is detected by the area detecting section and interrupt is generated by the interrupt generating section on the basis of the detection of the area head position. The interrupt causes the palette writing section to operate, so that predetermined color information corresponding to the small screen area whose head position has been detected is written into the palette.

In order to divide one screen vertically into a plurality of small screen areas each having a plurality of horizontal scan lines, the area setting section may have a plurality of area head position registers for storing horizontal scan line numbers indicating the area head positions of the respective small screen areas.

The area setting section may be part of an application section which is activated by the execution of an application program.

The area detecting section may comprise a counter for counting the number of horizontal sync pulses corresponding to the number of horizontal scan lines and comparators for comparing the count in the counter with the respective scan line numbers set by the area setting section to detect the area head positions on the basis of the comparison equality.

The interrupt generating section may count the occurrences of interrupts.

Further, the image display system according to another aspect of the present invention may be provided with a plurality of palettes for each of the small screen areas and select one of these palettes to thereby rewrite palette information.

The image display system of the present invention permits many colors to be represented on a screen.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

FIG. 8 shows the contents of the area head position registers of FIG. 7;

FIG. 9 shows the contents of the palette writing section of FIG. 3;

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

[Embodiment 1]

Figure 1:
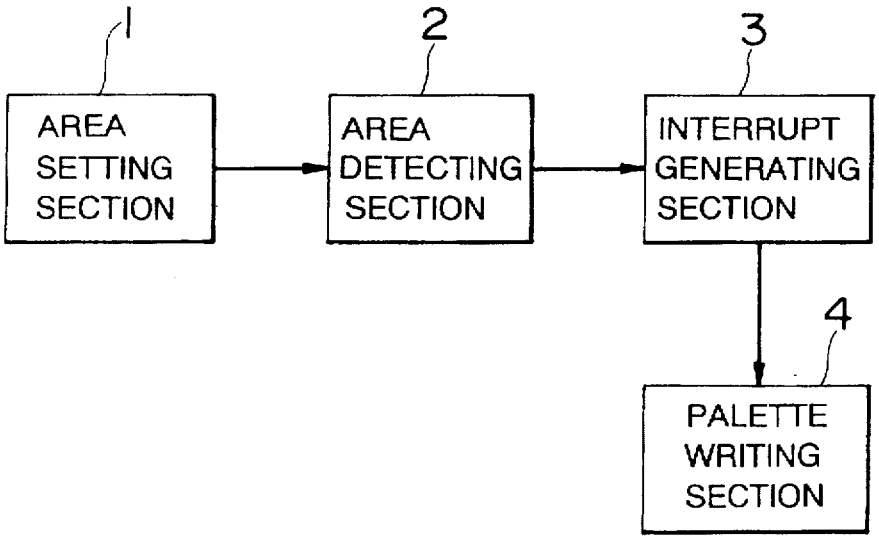
FIG. 1 is a block diagram of an image display system according to a first embodiment of the present invention.

Referring now to FIG. 1, there is shown a basic image display system of the present invention which comprises an area setting section 1, an area detecting section, an interruption generating section 3, and a palette writing section 4.

The area setting section 1 sets the head position (horizontal scan line position) of each of small screen areas into which a screen is divided vertically.

The area detecting section 2 detects the head position of each of the small screen areas set by the area setting section 1.

The interrupt generating section 3 generates an interrupt in response to the detection of the head position of each small screen area by the area detecting section 2.

In response to an interrupt generated by the interruption generating section 3, the palette writing section 4 writes display color information corresponding to each individual small screen area into a palette which associates color specification information with display color information.

Figure 2:
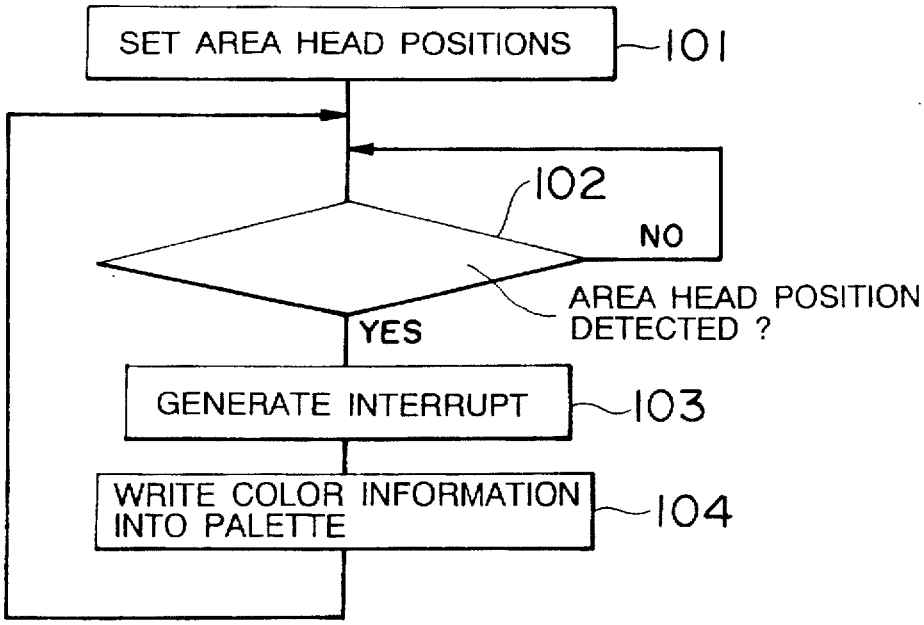
FIG. 2 is a flowchart for the image display operation of the system of FIG. 1.

In FIG. 2, there is shown a flowchart for the operation of the system of FIG. 1.

In step 101, the area setting section 1 sets the head position of each small screen area so as to vertically divide the screen into a plurality of small screen areas by one or more horizontal lines.

In step 102, the area detecting section 2 detects the head position of a small screen area set in step 101.

In step 103, the interrupt generating section 3 generates an interrupt each time the head position of a small screen area is detected in step 102.

In step 104, in response to the interrupt generated by the interrupt generating section 3 in step 103, the palette writing section 4 writes display color information for the corresponding small screen area into the palette.

Steps 102 to 104 are repeated each time the head position of a small screen area is detected.

In this system, the head position of each of small screen areas into which the screen is divided is set, an interrupt is generated each time the head position of a small screen area is detected, and subsequently display color information corresponding to the detected small screen area is written into the palette.

Therefore, even if the screen is divided into a plurality of small screen areas and the contents of the palette are varied with the small screen areas, there is no need for an application program to perform polling, and more colors than can be displayed simultaneously by the system itself can be displayed on the entire screen.

[Embodiment 2]

Figure 3:
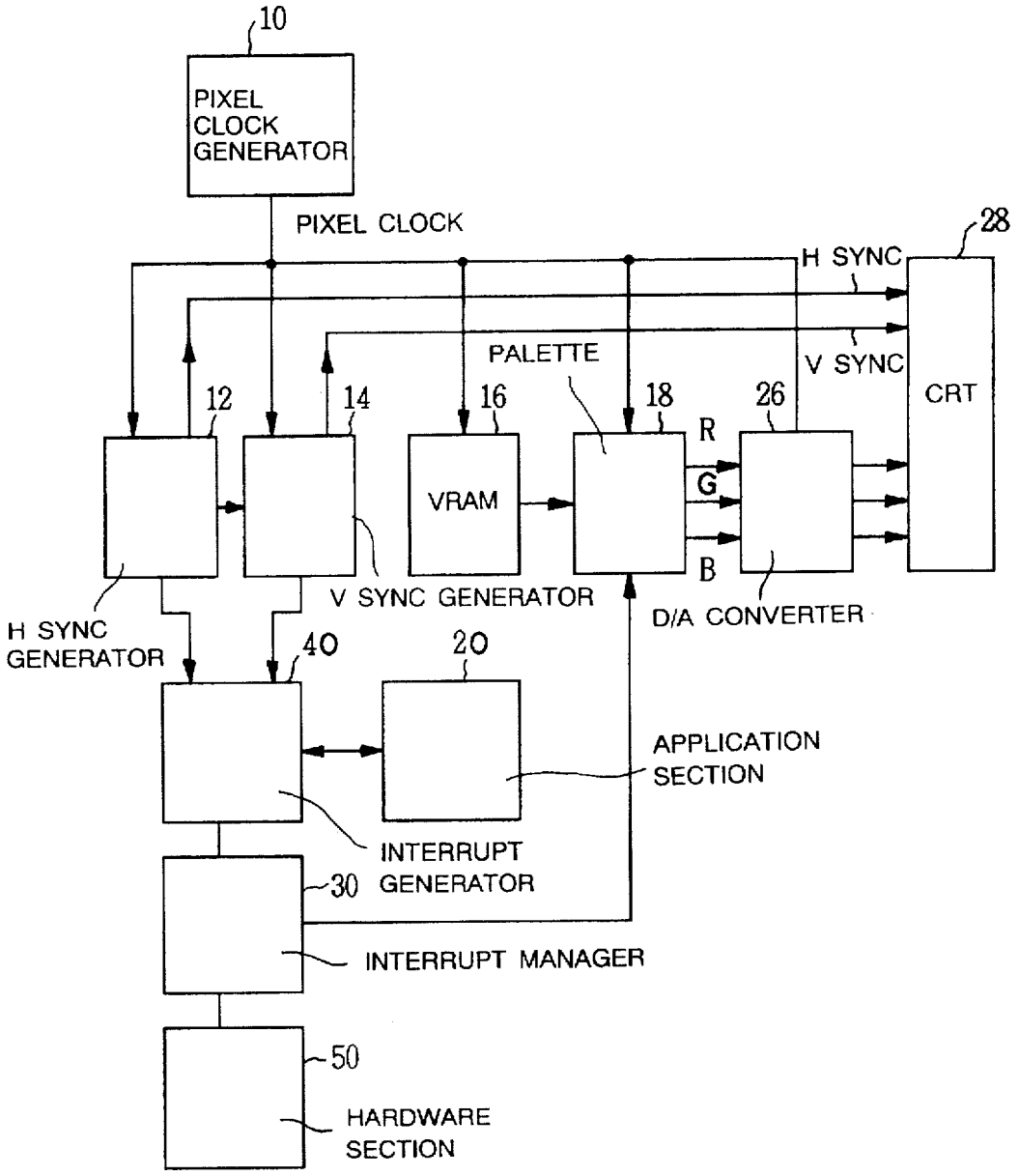
FIG. 3 is a block diagram of an image display system according to a second embodiment of the present invention.

An image display system according to a second embodiment of the present invention is shown in FIG. 3.

<Configuration>

The image display system shown in FIG. 3 is provided with a pixel clock generator 10, a horizontal sync signal generator 12, a vertical sync signal generator 14, a video random access memory (VRAM) 16, a palette 18, an application section 20, a digital-to-analog (D/A) converter 26, a cathode ray tube (CRT), an interrupt manager 30, an interrupt generator 40, and hardware section 50. The pixel clock generator 10 generates clocks for pixels making up a display screen.

<Horizontal Sync Signal Generator 12>

The horizontal sync signal generator 12 generates a horizontal sync signal (H sync) for application to the CRT 28 and the interrupt generator 40.

Figure 4:
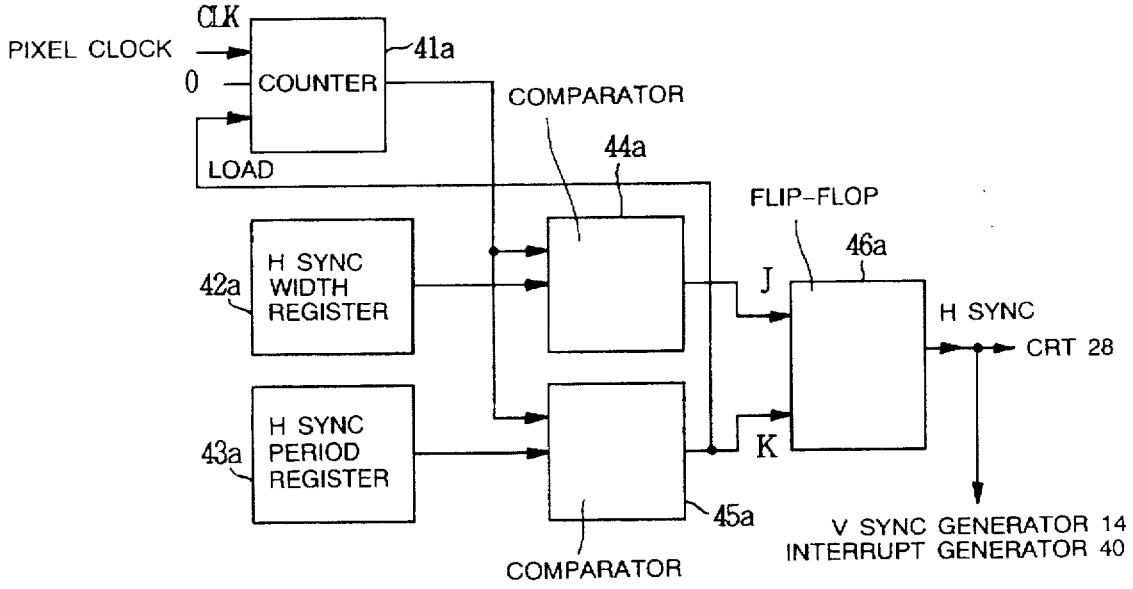
FIG. 4 is a block diagram of the horizontal sync signal generator of FIG. 3.

Referring to FIG. 4, the horizontal sync signal generator 12 comprises a counter 41*a*, a horizontal sync width register 42*a*, a horizontal sync period register 43*a*, a comparator 44*a*, a comparator 45*a*, and a flip-flop (FF) 46*a*.

The counter 41*a* counts pixel clocks output from the pixel clock generator 10. The counter 41*a* is connected at its output to the comparators 44*a* and 45*a*.

The horizontal sync width register 42*a* holds pulse width information of the horizontal sync signal. The horizontal sync period register 43*a* holds pulse repetition period information of the horizontal sync signal.

The comparator 44*a* makes a comparison between the pulse width information in the horizontal sync width register 42*a* and the count in the counter 41*a*. When the count reaches a value corresponding to the pulse width information, the comparator 44*a* sets the J terminal of the flip-flop 46*a*.

The comparator 45*a* makes a comparison between the pulse period information in the horizontal sync period register 43*a* and the count in the counter 41*a*. When the count reaches a value corresponding to the pulse period information, the comparator 45*a* resets the K terminal of the flip-flop 46*a* and applies a load pulse to the counter 41*a* to return it to the initial state. By being set by the comparator 44*a* and reset by the comparator 45*a*, the flip-flop 46*a* is permitted to generate a horizontal sync signal.

<Vertical Sync Signal Generator 14>

The vertical sync signal generator 14 generates a vertical sync signal (V sync) for application to the CRT 28 and the interrupt generator 40.

Figure 5:
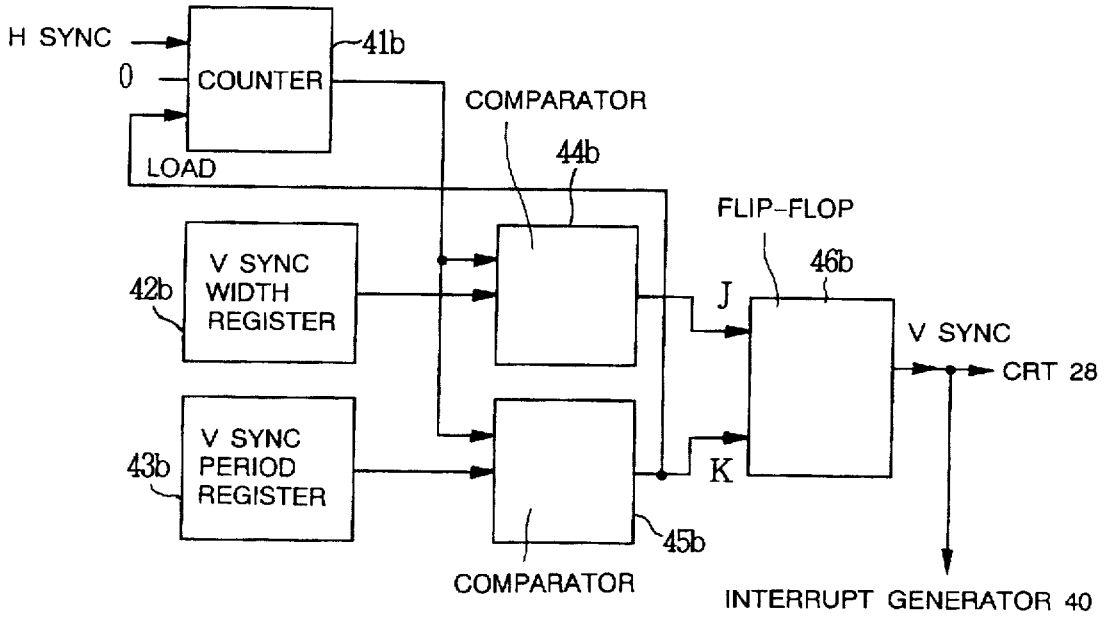
FIG. 5 is a block diagram of the vertical sync signal generator of FIG. 3.

In FIG. 5, there is shown the vertical sync signal generator 14 in block form, which comprises a comparator 41*b*, a vertical sync width register 42b, a comparator 44b, a comparator 45b, and a flip-flop (FF) 46b.

The counter 41b counts pulses in the horizontal sync signal. The counter 41b is connected at its output to the comparators 44b and 45b.

The vertical sync width register 42b holds pulse width information of the vertical sync signal. The vertical sync period register 43b holds pulse repetition period information of the vertical sync signal.

The comparator 44b makes a comparison between the pulse width information in the vertical sync width register 42b and the count in the counter 41b. When the count reaches a value corresponding to the pulse width information, the comparator 44b sets the J terminal of the flip-flop 46b.

The comparator 45b makes a comparison between the pulse period information in the horizontal sync period register 43b and the count in the counter 41b. When the count reaches a value corresponding to the pulse period information, the comparator 45b resets the K terminal of the flip-flop 46b and applies a load pulse to the counter 41b to return it to the initial state. By being set by the comparator 44b and reset by the comparator 45b, the flip-flop 46b is permitted to generate a vertical sync signal.

<Interrupt Generator 40>

The interrupt generator 40 generates an interrupt at the scan starting point of each of small screen areas into which a display screen is divided. The interrupt generator is controlled by the application section 20, which is activated by the execution of an application program, to generate interrupts to the interrupt manager 30.

Figure 7:
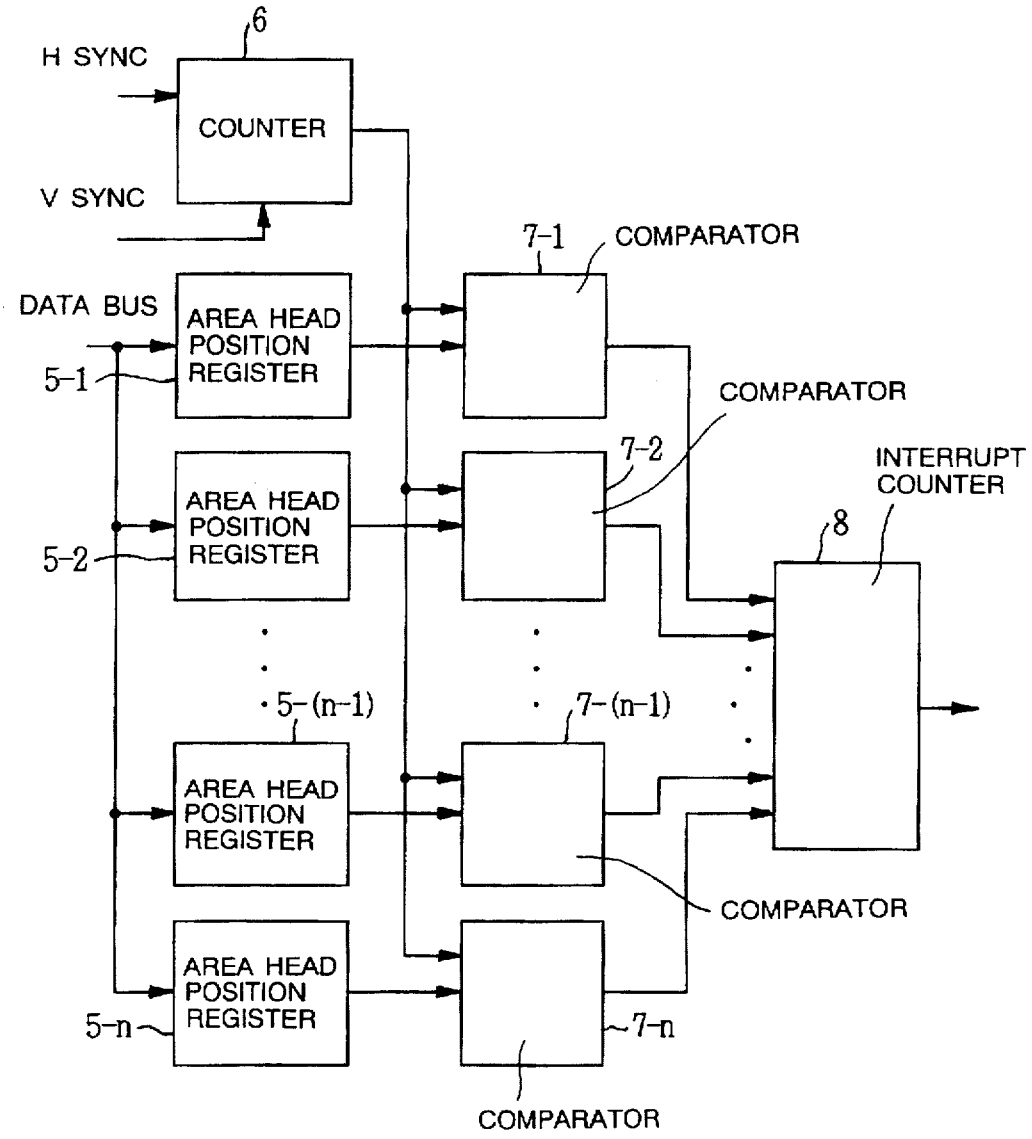
FIG. 7 is a block diagram of the interrupt generator of FIG. 3.

Referring to FIG. 7, the interrupt generator 40 comprises area head position registers 5-1 to 5-n provided for the respective small screen areas, a counter 6, comparators 7-1 to 7-n, and an interrupt counter 8.

The area head position registers 5-1 to 5-n are connected to a common data bus. Each of the registers stores area head position (horizontal scan line position) information, at which an interrupt is to be generated, as a scan line number.

FIG. 8 shows scan line numbers stored in the area head position registers 5-1 to 5-n. For example, a scan line number H1 is stored in the register 5-1. Each of the registers is required to have a sufficient number of bits to represent all the scan line numbers in the entire screen. For the 480-th horizontal scan line by way of example, nine bits are needed.

The counter 6 counts horizontal sync pulses from the horizontal sync signal generator 12 and is reset by a vertical sync pulse. The counter 6 is also required to have a sufficient number of bits to represent the horizontal scan line numbers. The counter is connected at its output to the comparators 7-1 to 7-n.

The area head position registers 5-1 to 5-n are connected to the comparators 7-1 to 7-n, respectively. Each of the comparators 7-1 to 7-n makes a comparison between the output of the corresponding register and the output of the counter 6 and produces an output "1" when the comparison indicates equality.

For example, when the count in the counter 6 coincides with the scan line number H1 in the register 5-1, the comparator 7-1 produces an output "1". When the count in the counter 6 coincides with the scan line number H2 in the register 5-2, the comparator 7-2 produces an output "1". Of course, each of the comparators may be arranged to produce an output "0" when the comparison indicates equality. The comparators 7-1 to 7-n are connected to the interrupt counter 8.

The interrupt counter 8 is incremented by one each time one of the comparators 7-1 to 7-n produces an output "1", thereby counting the number of interrupts generated.

The VRAM shown in FIG. 3 stores display data to be displayed on the CRT 28, the display data being applied to the palette 18. The display data stored in the VRAM 16 covers, for example, 4,096 or 16,000 colors for each pixel.

<Palette 18>

The palette 18 stores a palette of color data (lookup table). The palette 18 is a 256-color palette for 256-color data representation or a 16-color palette for 16-color data representation.

Figure 10:
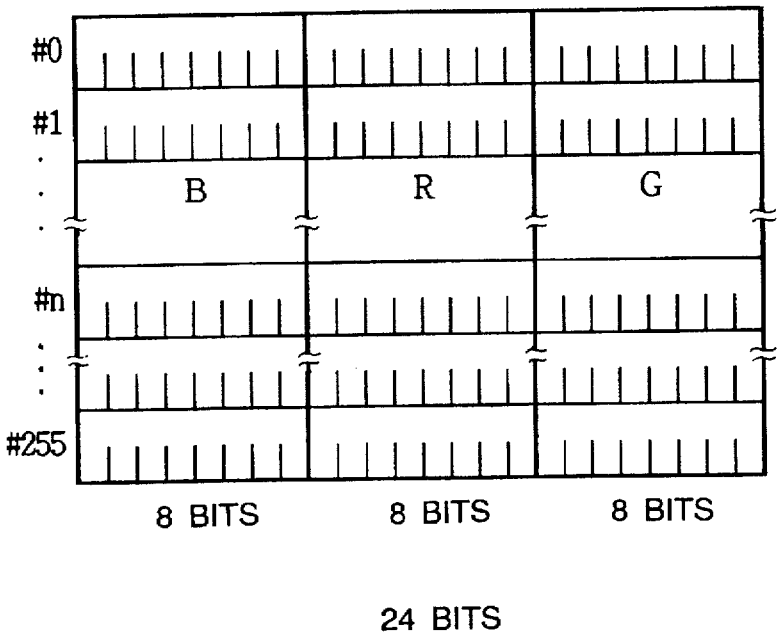
FIG. 10 shows the 256-color palette of FIG. 3.

The 256-color palette is used for 256-color display and stores RGB values for 256 colors previously selected out of 16,000 colors in a one-to-one correspondence with palette numbers (#0–#255). FIG. 10 shows a 256-color palette structure. In the 256-color palette, an R value, a G value and a B value are each of 8-bit data, and thus color data selected for each palette number consists of 24 bits.

The 16-color palette is used for 16-color display and stores RGB values of each of 16 colors previously selected out of 4,096 colors for each individual palette number (#0–#15).

In the present system, the 16-color palette is used for a two-screen display mode (in which display using two screen layers of screen layers 1 and 0 is permitted), and the 256-color palette is used for a one-screen display mode.

The palette 18 converts display data of 4,096 colors to RGB data of 16 colors through the 16-color palette and then applies them to the D/A converter 26. That is, the palette 18 performs a process of converting display data having 4,096 color gradations to RGB data having 16 color gradations. The palette 18 likewise converts 16,000-color display data to 256-color RGB data.

The D/A converter 26 converts RGB digital data from the palette 18 to an analog signal for display on the CRT 28.

<Application Section 20>

Figure 6:
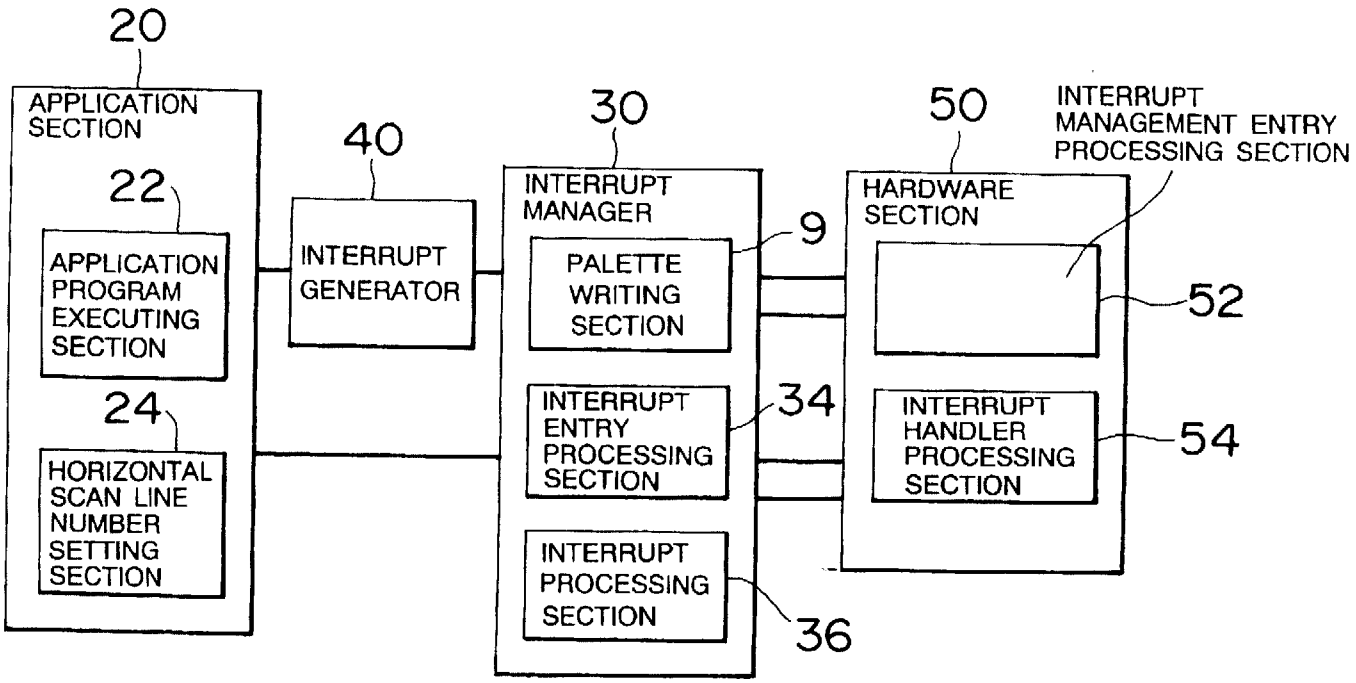
FIG. 6 is a block diagram of the application section and the interruption management section of FIG. 3.

The image display system of FIG. 3 is provided, as described above, with the application section 20, the interrupt manager 30, and the hardware section 50, their arrangements being illustrated in FIG. 6.

The application section 20 executes an application program in the application program executing section 22 and passes control to the interrupt manager 30 when an interrupt occurs in the hardware section 50. The interrupt manager 30 may be part of the BIOS (basic input/output system). When an interrupt occurs, the CPU (central processing unit) is suspended and then handles the interrupt.

The application section 20 has a scan line number setting section 24 which sets the scan line numbers defining the head positions of the respective small screen areas in the registers 5-1 to 5-n as area head position information.

The interrupt manager 30 has a palette writing section 9 for writing into the palette 18 to set/update its contents.

FIG. 9 shows the contents of the palette writing section 9. The section 9 has a table in which palette setting data P2 to Pn are stored associated with interrupt numbers I1 to In indicating interrupts generated.

Each time an interrupt is generated, the palette writing section 9 refers to that table to rewrite the contents of the 256-color palette shown in FIG. 10 by the contents corresponding to the palette setting data.

In this case, each time an interrupt is generated, the palette writing section 9 rewrites at least one of palette R, G and B data for a corresponding small screen area.

Further, the interrupt manager 30 has an interrupt entry processing section 34 and an interrupt handler processing section 36. The hardware section 50 is connected to the interrupt manager 30.

The hardware section 50 has an interrupt management entry processing section 52 and an interrupt handler processing section 54.

The interrupt management entry processing section 52 enters interrupts for rewriting the palette 18 into the interrupt manager 30. The interrupt entry processing section 34 accepts a specified interrupt, analyzes the factor of the interrupt at the time of the interrupt generation and passes control to an interrupt handler into which the factor has been entered.

The interrupt handler processing section 54 performs processing of the interrupt handler and then passes control to the interrupt manager 30. Note here that the interrupt handler refers to a program for handling interrupts. When an interrupt occurs, the CPU suspends its task and passes control to the interrupt handler.

The interrupt processing section 36 performs termination processing on the interrupt handler and then returns control to the application program executing section 22 to restore it to the point at which a hardware interrupt occurred.

<Processing>

Figure 11:
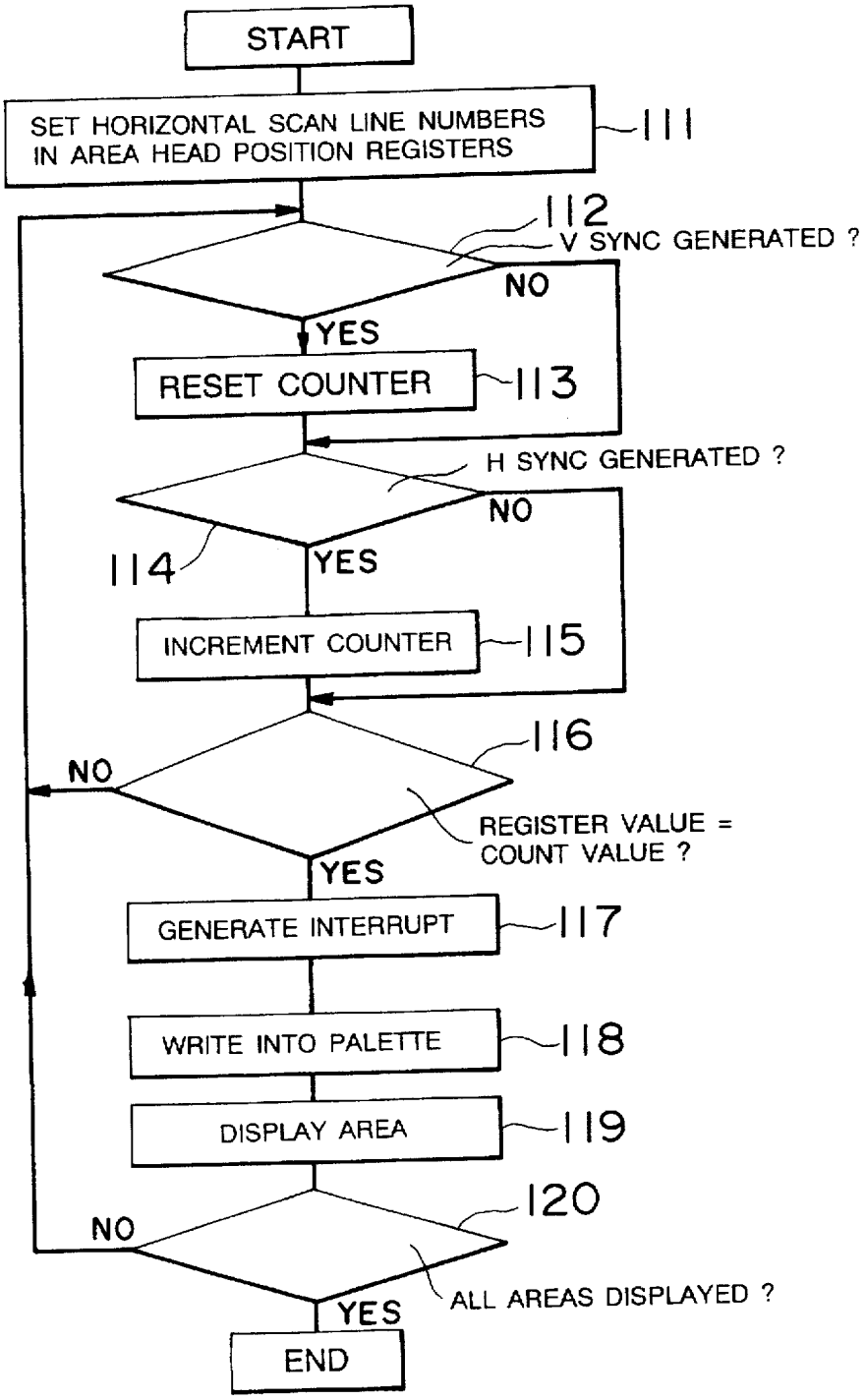
FIG. 11 is a flowchart for the image display operation of the system of FIG. 3.
Figure 12:
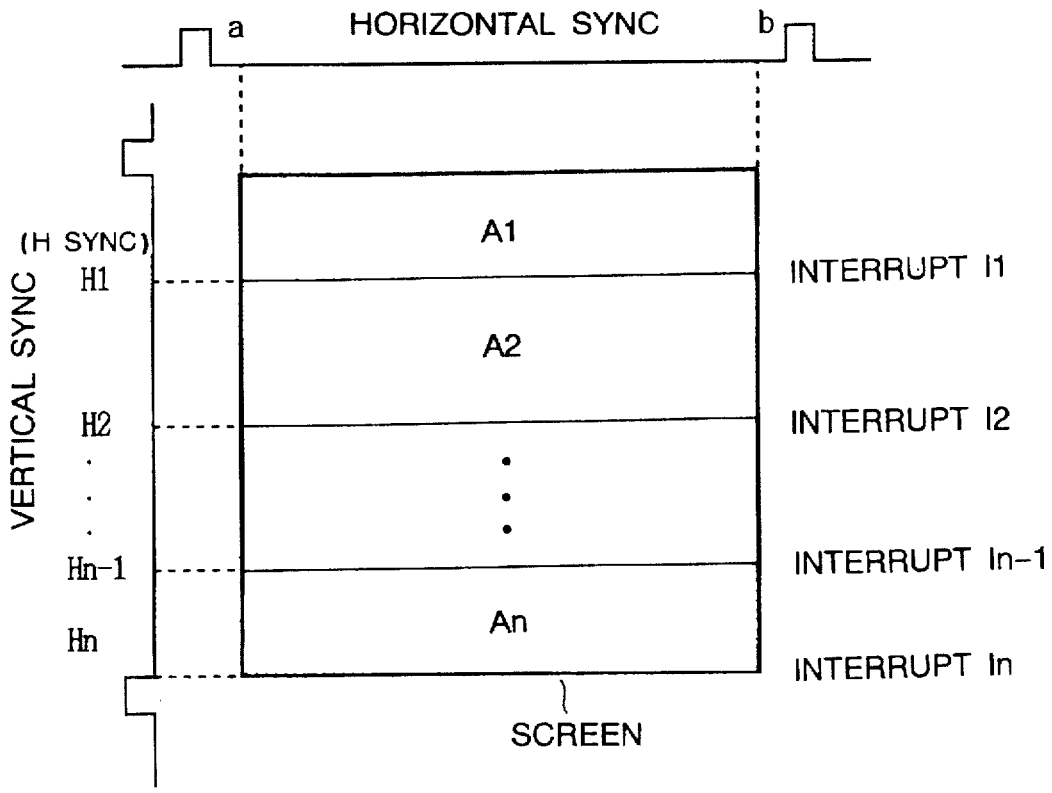
FIG. 12 shows the timing of generation of interrupts in the system of FIG. 3.

FIG. 11 illustrates a process flow of the present image display system. FIG. 12 shows times when interrupts are generated in the present system.

First, the scan line number setting section 24 sets scan line numbers Hi to Hn adapted to generate interrupts for the small screen areas in the area head position registers 5-1 to 5-n, respectively, as shown in FIG. 8 (step 111).

Next, a decision is made as to whether or not a vertical sync signal has been generated in the vertical sync signal generator 14 (step 112). In the vertical sync signal generator 14, the comparator **44*b* compares the count in the counter 41*b* with the pulse width information in the vertical sync width register 42*b*, and the comparator 45*b* compares the count in the counter 41*b* with the pulse period information in the vertical sync period register 43*b*. In response to the comparisons the flip-flop 46*b*** produces a vertical sync signal.

If a vertical sync signal has already been produced, then the counter is reset by it (step 113).

Subsequently, a decision is made as to whether or not a horizontal sync signal has been generated in the horizontal sync signal generator 112 (step 114). In the horizontal sync signal generator 12, the comparator **44*a* compares the count in the counter 41*a* with the pulse width information in the horizontal sync width register 42*a*, and the comparator 45*a* compares the count in the counter 41*b* with the pulse period information in the horizontal sync period register 43*a*. In response to the comparisons the flip-flop 46*a*** produces a horizontal sync signal.

If, in step 112, the decision is that a vertical sync signal has not been generated, then the process flow immediately proceeds to step 114.

Next, the number of the horizontal sync signals generated is counted by the counter 6 shown in FIG. 7 (step 115). The comparators 7-1 to 7-n compare the count in the counter 6 with the respective values H1 to Hn set in the area head position registers 5-1 to 5-n (step 116). If the count is not equal to any of the set values, then the process flow returns to step 112 so as to repeat steps 112 to 115.

If, on the other hand, the count has become equal to the scan line number H1 set in the register 5-1, that is, if the head position of an area has been reached, then the comparator 7-1 will generate an output "1" to the interrupt counter 8, thereby generating an interrupt. The counter 8 is incremented to 1, which informs the palette writing section 9 of the first occurrence of an interrupt (step 117).

The palette writing section 9 then refers to the palette data P2 set in the table shown in FIG. 9 in accordance with the count 1 in the counter 8 indicating the first occurrence of an interrupt and then rewrites the contents of the palette 18 by the palette setting data P2 (step 118).

The area A2 is displayed on the CRT 28 in accordance with the palette data P2 thus set in the palette 18 (step 119).

Subsequently, a decision is made as to whether or not all the areas in the entire screen have been displayed (step 120). If all the areas have not been displayed yet, then the process flow returns to step 112 so as to repeat steps 112 to 119. At the scan line number Hn, the number of interrupt occurrences reaches n, with the result that the area A1 is displayed in a color defined by the palette data P1. After each of the small screen areas A1 to An has thus been displayed, the processing terminates.

According to the present system, the application side specifies a plurality of scan line numbers H1 to Hn to cause a corresponding number of interrupts to occur and writes a set value (P1 to Pn) into the palette on the occurrence of each interrupt. Thus, each of the small screen areas A1 to An can be displayed in a different color based on RGB values. For example, with the 256-color palette and n small screen areas, colors n times 256 can be represented.

Thus, the proper use of a palette for a plurality of small screen areas permits more colors than can originally be displayed simultaneously to be displayed without the need for the application section 20 to perform polling.

[Embodiment 3]

Figure 13:
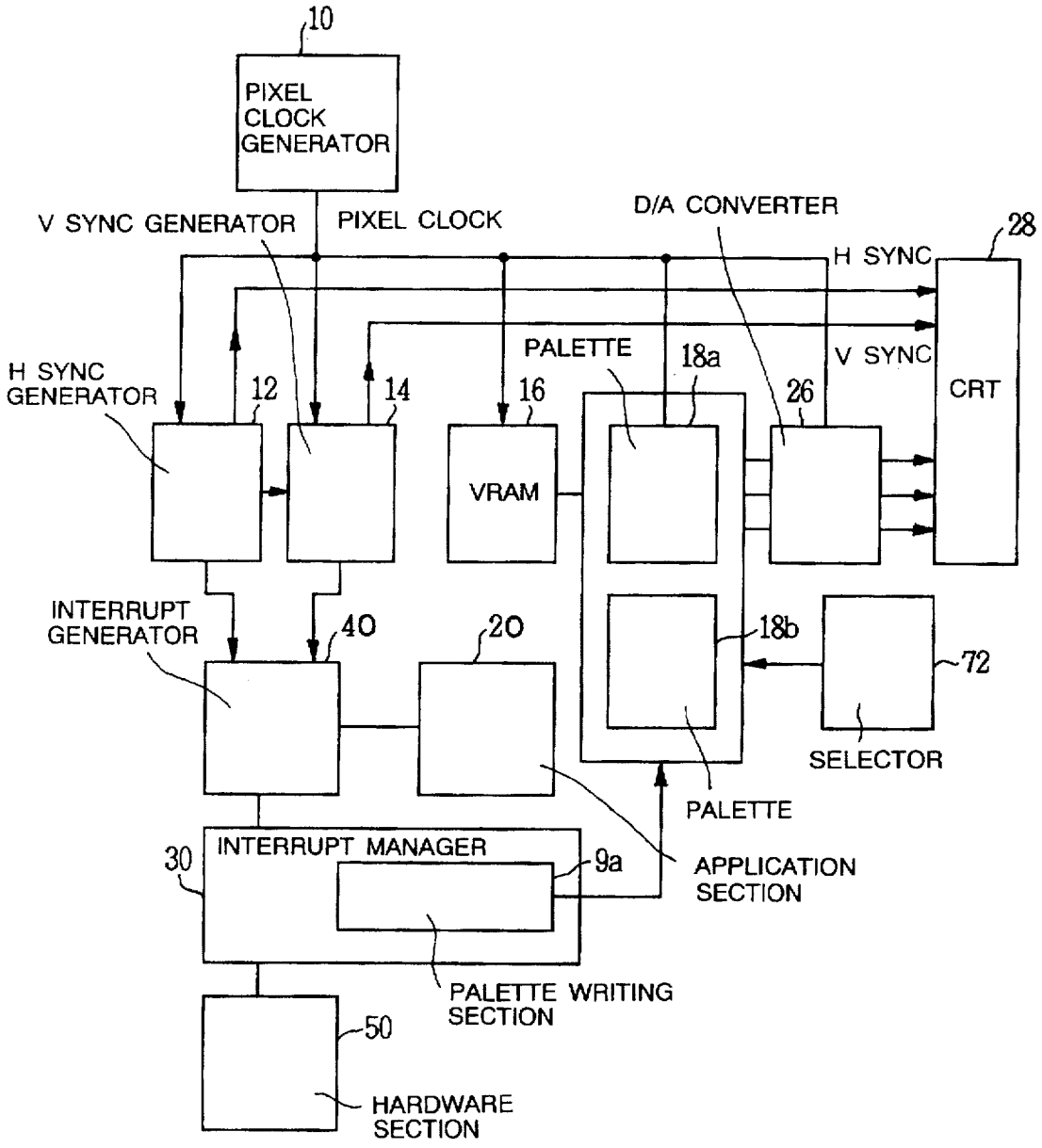
FIG. 13 is a block diagram of an image display system according to a third embodiment of the present invention.

Referring now to FIG. 13 there is shown an image display system according to a third embodiment of the present invention.

The image display system shown in FIG. 13 is provided with two palettes **18*a* and 18*b* and a selector 72 for selecting either the palette 18*a* or the palette 18*b*. The palette 18*a* is a 256-color palette, while the palette 18*b* is a 16-color palette. Each time an interrupt occurs, a palette writing section 9*a* in an interrupt manager 30 writes display color information for a corresponding small screen area into a selected one of the palettes 18*a* and 18*b***.

According to such a configuration in which either the 256-color palette or the 16-color palette is selected by the selector 72 and display color information associated with the small screen areas A1 to An is written into the selected palette, if the 16-color palette is selected, then colors n times 16 will be displayed. This permits the free selection of display colors.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method of displaying an image on a screen divided into a plurality of small screen areas related to sets of palette data respectively associating color specifying information with display color information using a palette to store the sets of palette data and convert the color specifying information into the display color information, comprising the steps of:

(a) defining a position of each of a plurality of small screen areas into which the screen is to be divided;

(b) detecting positional agreement between a scan line to be scanned next and a head position of any of the small screen areas during image display on the screen;

(c) generating an interrupt in response to detection of the positional agreement in step (b); and (d) writing a set of the palette data for a corresponding small screen area into the palette in response to said generating of the interrupt.

2. A method according to claim 1, wherein said defining in step (a) comprises the substeps of:

(a1) dividing the screen vertically into the plurality of small screen areas, and (a2) setting a scan line number corresponding to a head position of each of the small screen areas to define the position of each of the small screen areas.

3. A method according to claim 2, wherein said defining in step (a) further comprises the substep of (a3) storing the scan line number for each of the small screen areas in a respective one of a plurality of area position registers.

4. A method according to claim 2, wherein said detecting in step (b) comprises the substeps of:

(b1) counting a number of scan lines in dependence upon horizontal sync pulses, and (b2) detecting the positional agreement between the scan line to be scanned next and the head position of any of the small screen areas by comparing the number of the scan lines counted in step (b1) with the scan line number set for each of the small screen areas.

5. A method according to claim 1, wherein said generating in step (c) repeatedly generates the interrupt each time the positional agreement is detected.

6. A method according to claim 1, wherein said writing in step (d) includes rewriting only at least part of the display color information in the palette for each of the small screen areas.

7. A method according to claim 1, wherein the screen can display a first number of colors and each set of the palette data can represent a second number of colors smaller than the first number of colors.

8. A color display device for a display screen comprising:

palette means for storing palette information associating color specifying information with display color information;

area setting means for setting a position of each of a plurality of small screen areas into which the display screen is to be divided;

detecting means for detecting positional agreement between a scan line to be scanned next and a head position of any of the small screen areas during image display on the display screen;

interrupt generating means for generating an interrupt in response to detection of the positional agreement by said detecting means; and palette writing means for writing a set of display color information for a corresponding small screen area into said palette means in response to the interrupt generated by said interrupt generating means.

9. A device according to claim 7, wherein said area setting means includes line number setting means for setting a scan line number corresponding to a head line of each of the small screen areas to define the position of each of the small screen areas.

10. A device according to claim 8, wherein said area setting means includes means for setting the position of each of the small screen areas in response to execution of an application program.

11. A device according to claim 9, wherein said line number setting means includes:

area position registers, and means for storing the scan line number set for each of the small screen areas in a respective one of said area position registers.

12. A device according to claim 9, wherein said detecting means comprises:

counting means for counting a number of scan lines in dependence upon horizontal sync pulses, and comparing means for comparing the number of the scan lines counted by said counting means with the scan line number set for each of the small screen areas to detect positional agreement between a scan line to be scanned next and the head line of any of the small screen areas when the number of scan lines counted by said counting means matches the scan line number set by said line number setting means.

13. A device according to claim 8, wherein said interrupt generating means repeatedly generates the interrupt each time the positional agreement is detected.

14. A device according to claim 8, wherein said palette writing means includes means for rewriting only at least part of the display color information in said palette means for each of the small screen areas.

15. An image display device for displaying a color image on a display screen, comprising:

a plurality of palette means each storing a different set of palette information associating color specifying information with display color information;

selecting means for selecting one of said palette means;

area setting means for setting a position of each of a plurality of small screen areas into which the display screen is to be divided;

detecting means for detecting positional agreement between a scan line to be scanned next and a head position of any of the small screen areas during image display on the display screen;

interrupt generating means for generating an interrupt in response to detection of the positional agreement by said detecting means; and palette writing means responsive to the interrupt generated by said interrupt generating means for writing a set of display color information for a corresponding small screen area into the one of said palette means selected by said selecting means.

16. A device according to claim 15, wherein said plurality of palette means include palette means for storing a palette for two 16-color-palette screens.

17. A device according to claim 15, wherein said plurality of palette means include palette means for storing a palette for one 16-color-palette screen.

18. A device according to claim 17, wherein said plurality of palette means further include palette means for storing a palette for two 16-color-palette screens.

* * * * *

UNITED STATES PATENT AND TRADEMARK OFFICE

CERTIFICATE OF CORRECTION

PATENT NO. : 5,739,815

DATED : April 14, 1998

INVENTOR(S) : Mizutani

It is certified that error appears in the above-identified patent and that said Letters Patent is hereby corrected as shown below:

Col. 7, line 30, "Hi" should be --H1--.

Col. 10, line 1, "7" should be --8--.

Signed and Sealed this

Twenty-first Day of July, 1998

Bruce Lehman

*Attest:*

BRUCE LEHMAN

*Attesting Officer*

*Commissioner of Patents and Trademarks*